United States Patent [19]

Müeller

[11] 4,241,481

[45] Dec. 30, 1980

[54] METHOD AND APPARATUS FOR CONNECTING THE HARNESS CORDS AND THE HEDDLES OF A HARNESS

[75] Inventor: Otto Müeller, Uetikon am See, Switzerland

[73] Assignee: Staeubli Ltd., Horgen-Zuerich, Switzerland

[21] Appl. No.: 944,649

[22] Filed: Sep. 21, 1978

[30] Foreign Application Priority Data

Sep. 22, 1977 [CH] Switzerland ..... 11587/77

[51] Int. Cl.[2] ..... D03J 1/00

[52] U.S. Cl. ..... 28/299; 139/1 R; 139/85

[58] Field of Search ..... 28/299; 139/1 R, 85, 139/88, 89

[56] References Cited

U.S. PATENT DOCUMENTS

| | | | |
|---|---|---|---|
| 561,801 | 6/1896 | Lewis | 139/85 |
| 3,834,426 | 9/1974 | Muller | 139/85 |

FOREIGN PATENT DOCUMENTS

| | | | |
|---|---|---|---|
| 2315968 | 10/1974 | Fed. Rep. of Germany | 139/85 |

*Primary Examiner*—Henry Jaudon

*Attorney, Agent, or Firm*—Blanchard, Flynn, Thiel, Boutell & Tanis

[57] ABSTRACT

A method and apparatus for connecting harness cords to the heddles which are eventually to be used in a weaving machine. A harness cord is threaded through an upper eyelet of the heddle and is turned back on itself with the connection being fixed by a shrink hose which is shrunk over the eyelet, thereby clamping the harness cord to the upper eyelet. An apparatus is movably mounted on an assembly frame between the various harness assemblages. At each location on the frame, the apparatus holds the free end of the harness cord after it has been threaded through the eyelet on the heddle. A friction brake is utilized to hold the free end of the harness cord while the apparatus effects a tightening of the harness cord and a drawing of the eyelet into the unshrunk shrink hose. A cutting mechanism is provided to sever the harness cord between the eyelet and the friction brake. As the eyelet is pulled down into the center of the shrink hose, the harness cord is clamped between the inner sidewall of the shrink hose and the eyelet. A source of heat in the apparatus effects a shrinking of the shrink hose, the harness cord is clamped between the inner sidewall of the shrink hose and the eyelet. A source of heat in the apparatus effects a shrinking of the shrink hose and a securement of the harness cord to the heddle. The apparatus also includes structure for effecting an alignment of the thread guides in a predefined common plane and maintains this alignment throughout the connection of the harness cord to the heddle.

12 Claims, 7 Drawing Figures

METHOD AND APPARATUS FOR CONNECTING THE HARNESS CORDS AND THE HEDDLES OF A HARNESS

FIELD OF THE INVENTION

The invention relates to a method for connecting the upper harness cords of a harness assemblage for a Jacquard machine to the heddles, by maintaining equal tensions in the harness cords and equal or predescribed elevational position of the thread guides of the heddles, which connection occurs by means of a harness cord which is threaded through the upper eyelet of the heddle and is turned back on itself and the connection is secured by means of the shrink hose which is arranged above the connection, and an apparatus for carrying out the method.

BACKGROUND OF THE INVENTION

A harness of a Jacquard machine consists of a number of individual harness assemblages, for example 5,000–20,000. They consist of a metal heddle with an upper and a lower fastening eyelet and a thread guide, which heddle is connected at the lower side to an elastic cord or spring and at the upper side to a harness cord.

It is already known to manufacture the connection between the heddle and elastic cord with the lower anchor hook during prefabrication. Connection of these prefabricated parts to the harness cords must be done manually and is very tedious work. It is thereby common to first provide a temporary knot or a loop, which at a latter point in time permits the regulating of the height of the thread eye with respect to an imaginary plane. During a then following operation, the knot is then transferred into a final position, the free end of the cord is shortened and is covered in special cases with a hose or adhesive band. Since this is, in particular because of the large number of harness assemblages per machine, a very monotonous work, inaccuracies in the heddle height can result, which can lead to tolerance interferences during the weaving operation. A later correction of such deficiencies is very difficult, in particular when the connecting knots are covered with shrink hoses. The shrink hoses must then be cut open and the connection must newly be created and adjusted.

An object of the invention is to eliminate these disadvantages and to provide rational and exact manufacture of the connection of heddle and harness cord into one harness.

This object is attained by providing a method, which is characterized inventively by a plurality of harness assemblages being simultaneously connected with an apparatus and by each end of the harness cord, which end is threaded through the upper eyelet of the associated heddle, being under equal pretension and each heddle being moved with its thread guide to equal or predescribed height, while the shrink hose is moved on and shrunk.

To carry out the method, an apparatus is used, which is characterized by a magazine for several heddles, a support rail for the shrink hoses which are mounted on the heddles, a friction brake for the threaded ends of the harness cords and means for the reciprocal spacing of magazine and support rail.

With this, the connection is created finally in one operation in a mechanical and reproducible manner and without interpositioning of humanly influencible regulating operations.

BRIEF DESCRIPTION OF THE DRAWINGS

One exemplary embodiment of an apparatus according to the invention is illustrated in the drawings, in which.

DETAILED DESCRIPTION

Figure 1:
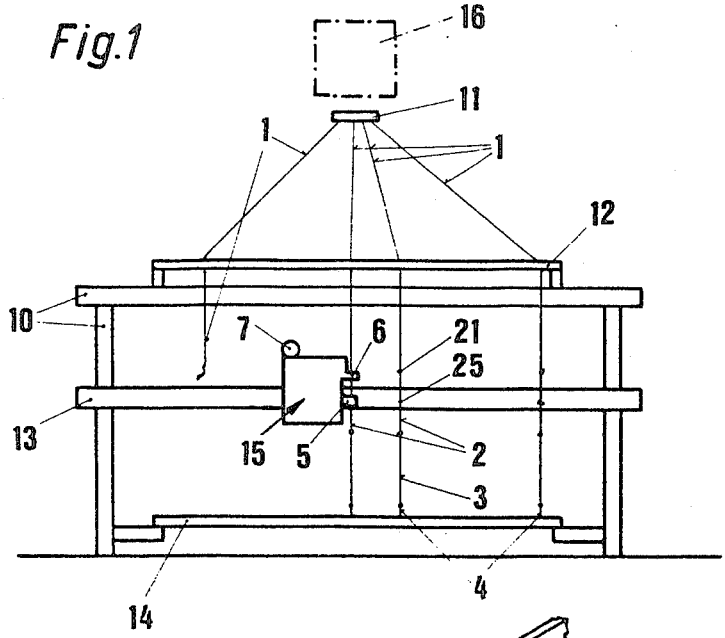
FIG. 1 is a schematic illustration of the harness of a Jacquard machine.

FIG. 1 illustrates a frame 10, which facilitates the manufacture and arrangement of a harness, as it will be used later on in a Jacquard weaving machine. The base plate 11, the comber board 12 and the anchor plate 14 are temporarily connected to the frame and provides the desired guidance for the harness assemblage consisting of harness cords 1 and the anchors 4 with the elastic cords 3. The heddles 2 are already tied in between the three harness cords 1 and the associated cords 3 which are shown on the right side of the frame. It is thereby of extreme importance to align the thread guides 25 of the heddles 2 exactly within a predefined, primarily horizontally arranged plane. However, the thread guides can also be aligned within a predetermined different, for example, inclined plane. The harness cord 1 on the left is not as yet connected to a heddle. Reference numeral 15 illustrates schematically the apparatus which is guided on a guide rail 13 on the frame 10, in which apparatus are integrated the members which are the basis of the invention. Reference numeral 16 indicate the position of the Jacquard machine, when the harness is arranged in a weaving machine. The connection which is to be created with the illustrated system is identified by the reference numeral 21.

The most important parts of the apparatus 15 which are illustrated in FIGS. 2 to 6 are the magazine 5, the friction brake 7, the cutting device 8 and the heating unit 9.

The heddles 2 are mounted with their thread guides 25 on the pins 50 of the magazine 5. The number of the pins corresponding with the number of the harness assemblages, which are connected in one sequence of operation. The magazine 5 is closed off by means of the lid 51 and the magazine or the lid has guide grooves 52 for the heddle frames of the heddles 2. The heddles can be transported or magazined with the magazine 5.

The support rail 6 has a U-shaped profile and the front edge of the lower leg 61 is constructed as a rake having a plurality of teeth, the spaces 62 between the teeth of which are wider than the thickness of the heddle frame of one heddle 2 and narrower than the outer diameter of the not as yet shrunk shrink hose 20. A round bar 7 extends in the illustrated exemplary embodiment on the upper side of the rail and functions as part of a friction brake. This round bar is adapted to fit between the two ribs 76 on the upper surface of the upper leg.

Reference numeral 8 identifies the cutting knife of the cutting device, the counterpart of which is the upper leg of the support rail 6.

Figure 2:
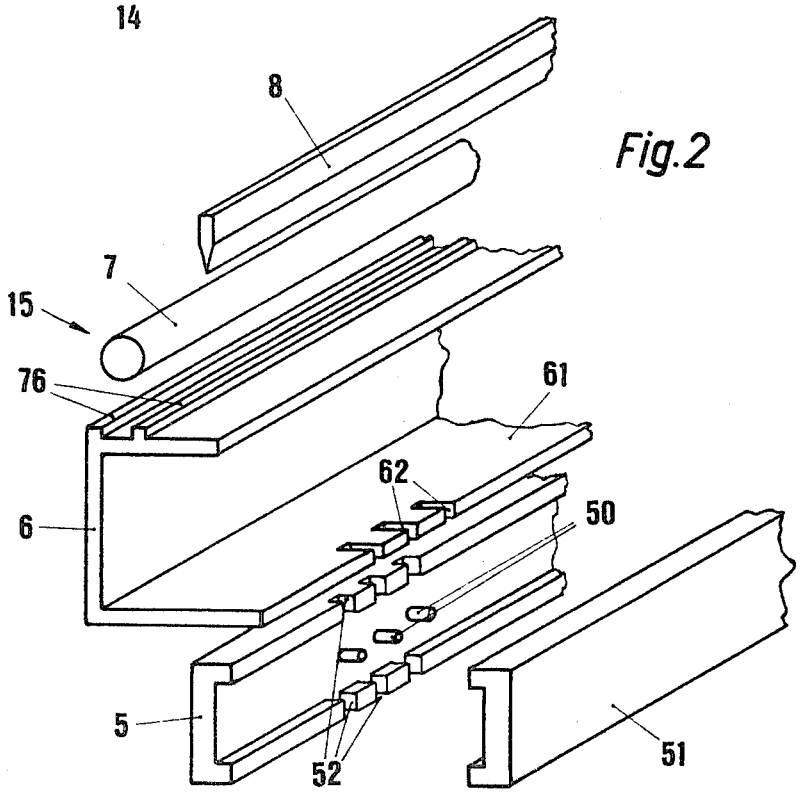
FIG. 2 is an exploded perspective view of the most important parts of the apparatus.

The inventive apparatus is completed by the heating rod 9, which is not illustrated in FIG. 2.

OPERATION

The system with the apparatus for connecting a heddle to a harness cord operates as follows:

At one end, the harness cords 1 are secured to the base plate 11 or to the Jacquard machine 16 and are pulled through the comber board 12 and at the other end, the apparatus 15 is mounted slidably on the guide rail 13 and one series of heddles 2 is inserted into the magazine 5.

Figure 3:
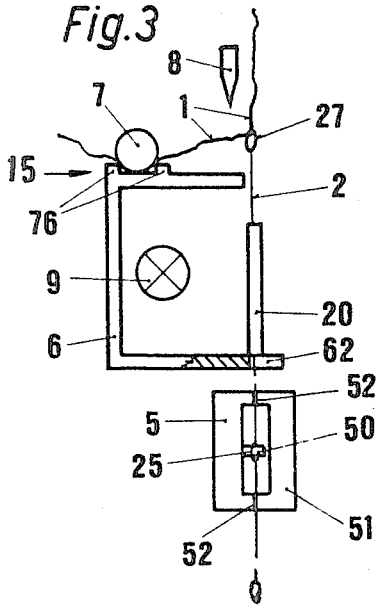
FIGS. 3 to 6 are each a schematic, partially in cross section, of the apparatus from which the sequence of operation can be taken.

The parts of the apparatus 15 assume the reciprocal position according to FIG. 3, so that the upper eyelet 27 of the heddle 2 extends above the upper leg of the support rail 6. The shrink hose 20 is moved over this projecting end of the heddle until it is positioned on the rake 62. The end of the harness cord 1 is pulled through the eyelet 27 and is placed under the round bar 7. The clamping between round bar 7 and ribs 76 acts as a friction brake onto the end of the cord.

Figure 4:
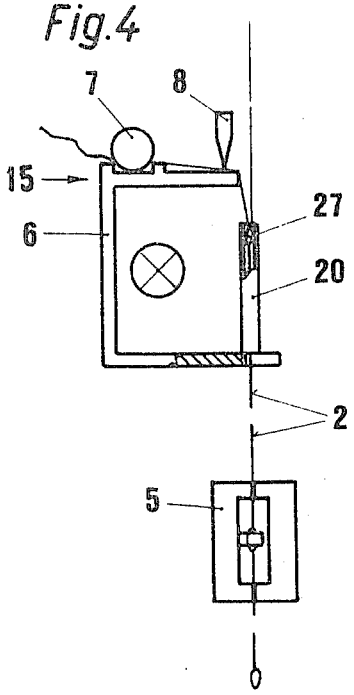
Figure 5:
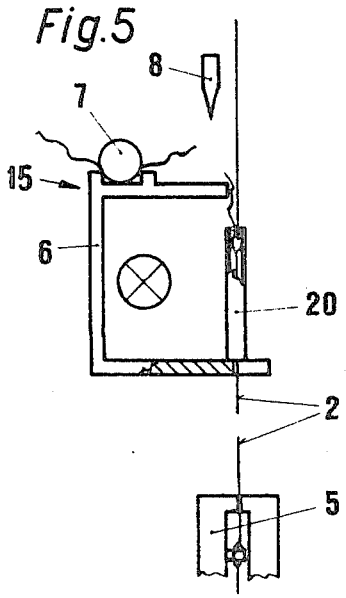

After this, the magazine 5 is lowered into the position according to FIG. 4 with respect to the support rail 6. The free end of the harness cord 1 is thereby stopped by the weight of the round bar 7, so that the entire harness cord is under tension. The moving of the eyelet 27 into the shrink hose 20 causes a temporary clamping of the deflected section of the harness cord, since the shrink hose 20 is dimensioned such that it adheres in nonshrunk condition with a small contact pressure on the end eyelet 27. In this position, the cord end is cut off with the cutting device 8 (FIG. 5).

Figure 6:
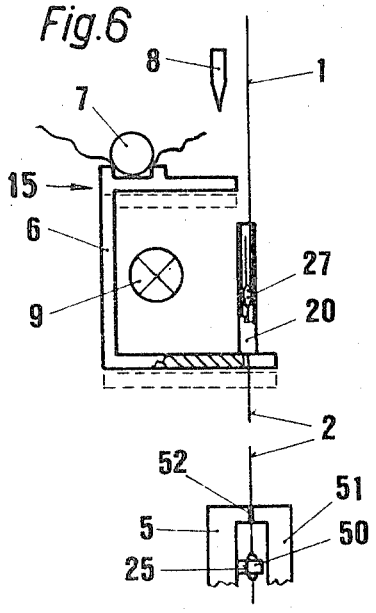

By further lowering of the magazine 5, the eylet 27 is pulled lower into the shrink hose 20. The magazne 5 is now lowered up to a fixed stop, which determines the desired height of the thread guide 25. The magazine 5 and support rail 6 are then spaced from one another in such a manner that the cord end is totally contained within the shrink hose (FIG. 6). The placement of all cord ends in the shrink hoses assures a similar tension of all harness assemblages, which is very important for the later operation of the Jacquard weaving machine. The shrink hose is now heated up by the heater 9 and shrunk and thus a snug enclosing and slip-resistant adhering of the end portion of the cord end in the eyelet 27 or on the heddle 2 is effected. It is thereby preferable to briefly lower the support rail 6, as shown in broken lines in FIG. 6, in order for the shrink hose to hang freely on the harness assemblage and to facilitate a proper and satisfactory shrinking of the lower edge.

A heating coil, an infrared radiator, a microwave device, a hot-air blower or the like can be provided as the source of heat 9. In addition, a reflector can be arranged on the side of the heater which is remote from the shrink hose, in order to facilitate an even shrinking process.

In place of a mechanical cutting device, it is also possible to provide a filament, which burns off the cord end.

The friction brake may also consist of a spring, for example a cup spring, into which the cord ends are pulled. In the case of the illustrated and described friction brake utilizing a round bar 7, it is preferable to form during threading, for example by rotation of the threader, a loop, into which the round bar is inserted.

In place of lowering the magazine 5, it is also possible to lift the support rail 6. It is important that all thread guides 25 are, when the harness cord 1 is tensioned, at the same or at the predetermined height.

With the described apparatus, it is possible to simultaneously provide a plurality of harness assemblages in an uninterrupted sequence of mechanically controlled operations, each harness assemblage having an exact adjustment of the thread guides and the tension in the harness cords.

The number of the commonly created harness assemblages depends from the size of the magazine 5 which is being used. Row after row of harness assemblages is manufactured and the apparatus 15 is shifted for each one row along the guide rail 13.

Figure 7:
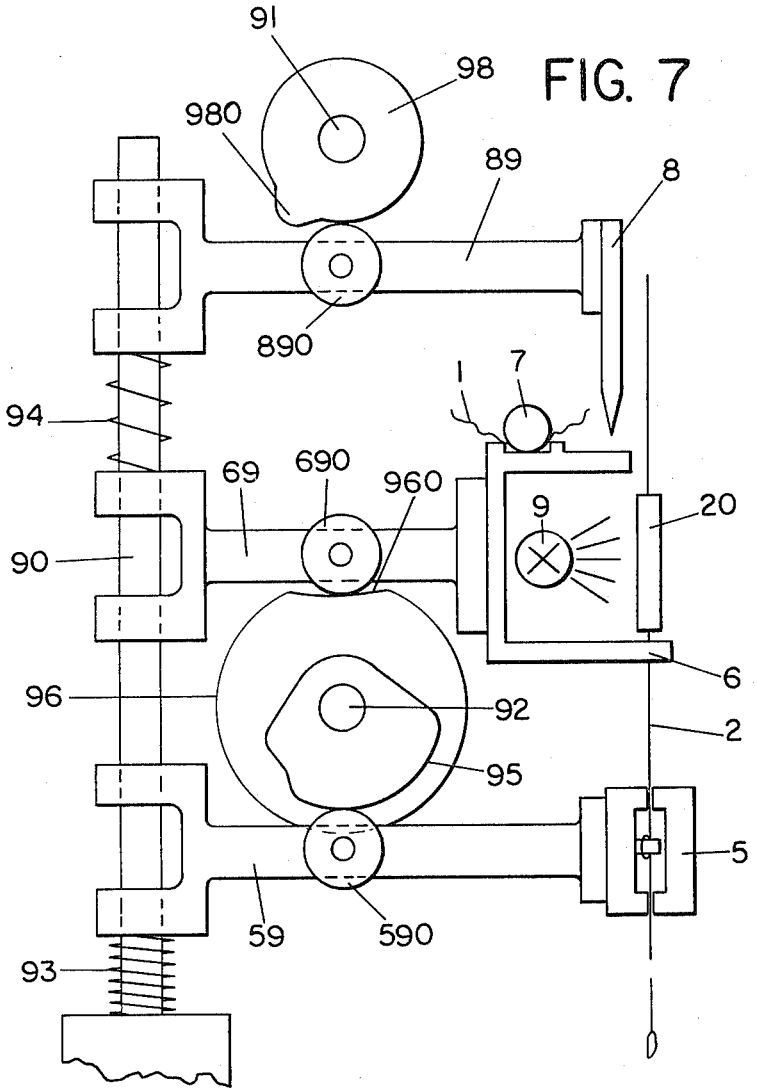
FIG. 7 illustrates a drive mechanism for the parts 5, 6 and 8.

FIG. 7 illustrates a drive mechanism for the parts 5, 6 and 8 of the apparatus 15, which parts move up and down. The magazine 5 is secured on the arm 59, the support rail 6 on the arm 69 and the cutting knife 8 on the arm 89. All three arms 59, 69 and 89 are secured movably up and down on the rod 90. The movements of the arms are controlled by the drive shafts 91 and 92, which rotate with the same driving speed and on which sit the three cam plates 95, 96 and 98.

The further elements which are illustrated in FIG. 7 are heddles 2 with the shrink hose 20, heat source 9, round bar 7 and harness cord 1.

The spring 93 presses the roll 590 of the arm 59 against the cam plate 95, the roll 690 of the arm 69 rests due to the weight of this arm and of the support rail 6 on the cam plate 96 and the spring 94 presses the roll 890 of the arm 89 against the cam plate 98.

The movements of the individual parts 5, 6 and 8 are described above. The cam 980 of the plate 98 effects a cutting off of the harness cord 1, the flat point 960 of the plate 96 effects the slow lowering of the support rail 6 with respect to the shrink hose 20 and the cam plate 95 effects the up and down movement of the magazine in which the heddles 2 are positioned.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a method for connecting the upper harness cords of the harness and assemblages for a Jacquard machine to the weaving heddles, by maintaining equal tensions in the harness cords and a predescribed elevational position of the thread guides of the heddles, which connection occurs by means of a harness cord which is threaded through the upper eyelet of the heddle and is turned back on itself and the connection is secured by means of a shrink hose which is arranged above the connection, wherein the improvement comprises a plurality of harness assemblages which are simultaneously connected to an apparatus and wherein each end of the harness cord which is threaded through the upper eyelet of the associated heddle is under equal pretension and each heddle is moved with its thread guide to a predescribed height, while the shrink hose is moved on and shrunk.

2. The method according to claim 1, wherein the ends of the harness cords are under the effect of an adjustable friction brake, while the eyelet of the heddle is moved into the shrink hose.

3. The method according to claim 1, wherein said prescribed height is an equal height.

4. An apparatus for connecting the upper harness cords of the harness assemblages for a Jacquard machine to the weaving heddles, by maintaining equal tensions in the harness cords and a predescribed elevational position of the thread guides of the heddles, which connection occurs by means of a harness cord which is threaded through the upper eyelet of the heddle and is turned back on itself and the connecton is secured by means of a shrink hose which is arranged above the connection, the improvement comprising a magazine for several heddles, a support rail for the shrink hoses which are mounted to the heddles, a friction brake for the threaded ends of the harness cords and means for the reciprocal spacing of magazine and support rail.

5. The apparatus according to claim 4, wherein the magazine has a series of pins, which are arranged at the predescribed height, over which the thread guides of the heddles are threaded, said magazine having guideways for defining the position of the heddles.

6. The apparatus according to claim 5, wherein said predescribed height for said pins is the same height.

7. The apparatus according to claim 4, wherein the support rail is constructed as a rake having plural teeth and the spacing between the teeth of the rake is greater than the thickness of one heddle and is smaller than the diameter of a nonshrunk shrink hose.

8. The apparatus according to claim 4, wherein the friction brake for the ends of the harness cords consists of a bar of circular-cylindrical shape arranged on a support means which extends parallel thereto and the cord ends are slippingly clamped between the bar and the support means.

9. The apparatus according to claim 8, wherein said support means is a pair of ribs which extends parallel to said bar.

10. The apparatus according to claim 4, wherein the friction brake for the ends of the harness cords consists of one cup spring and each one cord end is pulled in between adjacent cups.

11. The apparatus according to claim 10, wherein the friction brake is arranged on the support rail and a cutting device for the thread end is arranged between the friction brake and the upper eyelet of the heddle.

12. The apparatus according to claim 4, wherein above the support rail there is arranged a heating unit for shrinking the shrink hoses.

* * * * *

UNITED STATES PATENT AND TRADEMARK OFFICE

CERTIFICATE OF CORRECTION

PATENT NO. : 4 241 481

DATED : December 30, 1980

INVENTOR(S) : Otto Mueller

It is certified that error appears in the above—identified patent and that said Letters Patent is hereby corrected as shown below:

Change the surname of the inventor "Müeller" to ---Mueller---.

Column 4, line 49; delete "and".

Column 5, line 10; change "connecton" to ---connection---.

Column 5, line 15; change "to" to ---on---.

Column 6, line 19; change "10" to ---8---.

Signed and Sealed this

*Twenty-sixth* Day of *May 1981*

[SEAL]

*Attest:*

RENE D. TEGTMEYER

*Attesting Officer* *Acting Commissioner of Patents and Trademarks*